US006042351A

United States Patent [19]

Bushnell et al.

[11] Patent Number: 6,042,351

[45] Date of Patent: Mar. 28, 2000

[54] ENHANCED FLOW COMPRESSOR DISCHARGE PORT ENTRANCE

[75] Inventors: Paul J. Bushnell, Syracuse; Sue-Li Chuang, Manlius; Han-Jun Kim, Liverpool, all of N.Y.

[73] Assignee: Carrier Corporation, Syracuse, N.Y.

[21] Appl. No.: 08/986,451

[22] Filed: Dec. 8, 1997

[51] Int. Cl.[7] ..... F04C 2/00

[52] U.S. Cl. ..... 418/63; 418/67

[58] Field of Search ..... 418/63, 67

[56] References Cited

U.S. PATENT DOCUMENTS 5,069,607 12/1991 Da Costa ..... 418/63

5,616,017 4/1997 Iizuka et al. ..... 418/63

5,675,535 10/1997 Bushnell ..... 418/63

5,775,894 7/1998 Kosco, Jr. ..... 418/63

*Primary Examiner*—Thomas Denion

*Assistant Examiner*—Theresa Trieu

[57] ABSTRACT

A notch is provided in the motor end bearing of a rotary compressor in the region of the discharge port. The notch enhances the flow by smoothing the flow path and guiding the flow so as to impinge upon the discharge valve in a glancing manner and reduces the noise from the valve and valve stop and from the turbulent flow through the discharge port. The notch is located along the axis of the discharge valve and on the side of the valve port on which the valve is pivoted.

8 Claims, 5 Drawing Sheets

ENHANCED FLOW COMPRESSOR DISCHARGE PORT ENTRANCE

BACKGROUND OF THE INVENTION

In a fixed vane or rolling piston rotary compressor, the discharge port is in the motor end bearing. The discharge port is located such that about half of it overlies the piston bore and the remainder overlies the cylinder. The portion of the cylinder overlain by the discharge port is recessed to provide a fluid path from the cylinder bore to the discharge port. Accordingly, the discharge port faces the piston bore and recess. To provide a smooth flow path, the entrance to the discharge port is normally chamfered.

The discharge port is exposed to the compression chamber during the entire compression and discharge cycles. However, flow, other than that associated with the reduction in volume during the compression cycle, does not take place until the pressure in the compression chamber is sufficient to open the discharge valve against any bias and system pressure acting on the discharge valve and tending to keep it closed. It follows that there is normally a significant registration between the compression chamber and the discharge port at the time of opening of the discharge valve.

SUMMARY OF THE INVENTION

Although there is a significant registration between the compression chamber and the discharge port of a rolling piston rotary compressor, it has been determined that providing a streamlined port geometry influences the turbulent energy generated in the gas pulse through the valve port. There is evidence that this energy excites the valve stop at its resonance frequency. A notch is provided in the motor end bearing at the entrance to the discharge port. The notch is aligned with the direction of the discharge valve centerline and is located on the side of the discharge port corresponding to the pivoted end of the discharge valve. Accordingly, the notch provides a smooth transition for flow from the compression chamber to the discharge port. Additionally, the notch tends to direct the flow towards the free end of the valve, thereby providing a less circuitous path. Since the notch is localized, it does not unnecessarily add to the clearance volume.

It is an object of this invention to reduce the pressure drop across the discharge valve.

It is an additional object of this invention to reduce flow noise associated with gas pulsation through a valve port.

It is another object of this invention to minimize the additional clearance volume.

It is a further object of this invention to provide a smooth transition for the discharge flow. These objects, and others as will become apparent hereinafter, are accomplished by the present invention.

Basically, a notch is provided in a portion of the motor end bearing at the entrance to the discharge port such that flow is directed through the discharge port in a streamlined manner and towards the free end of the discharge valve.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
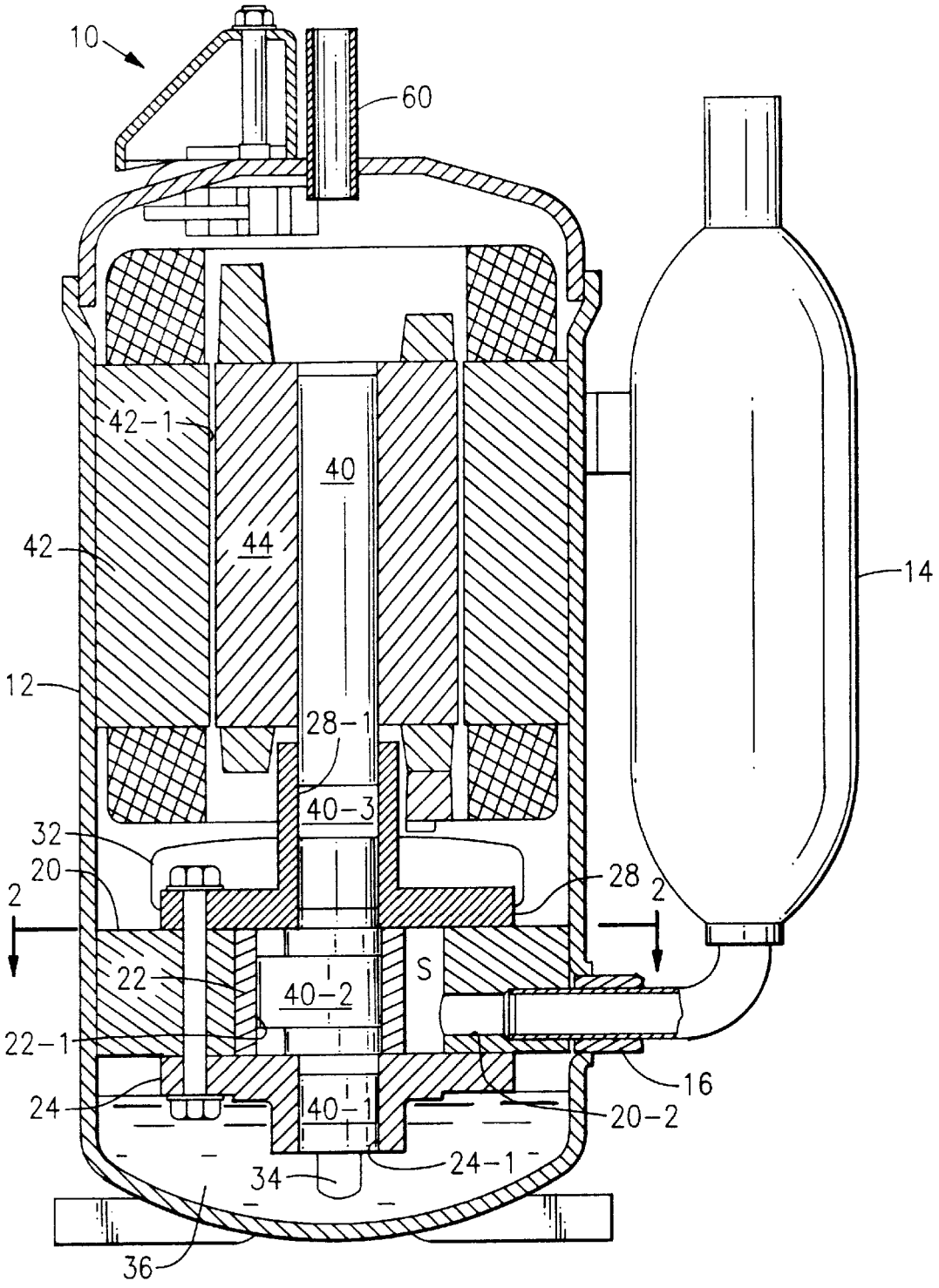
FIG. 1 is a vertical sectional view of a rolling piston compressor taken through the suction structure.
Figure 2:
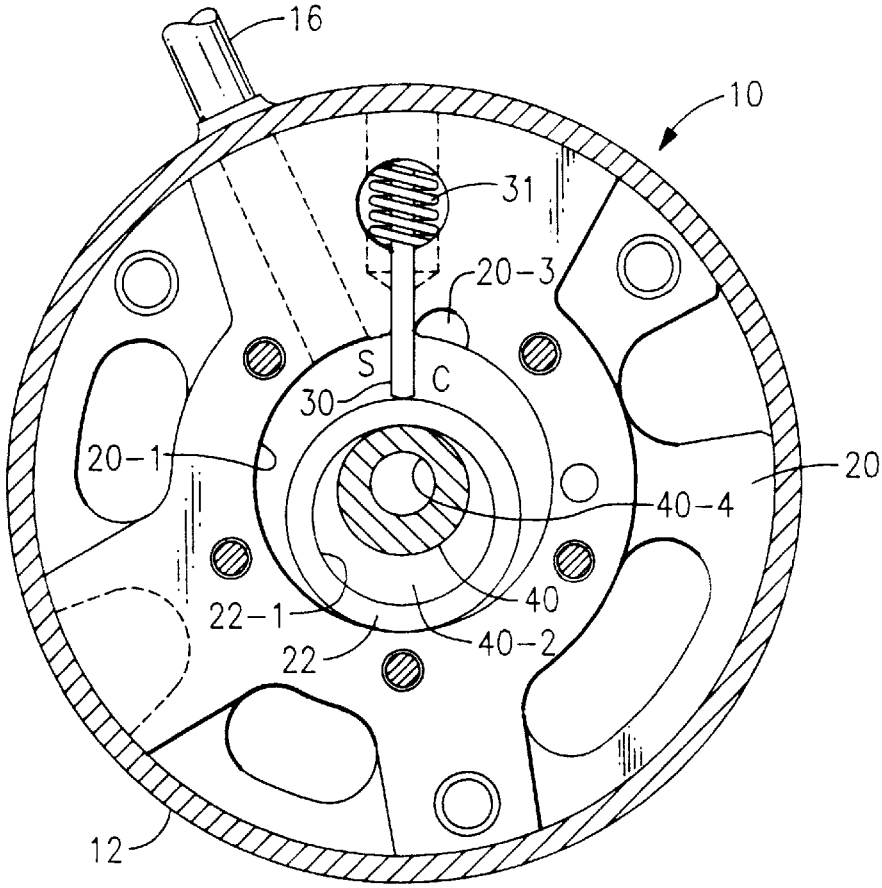
FIG. 2 is a sectional view taken along line 2—2 in FIG. 1.
Figure 3:
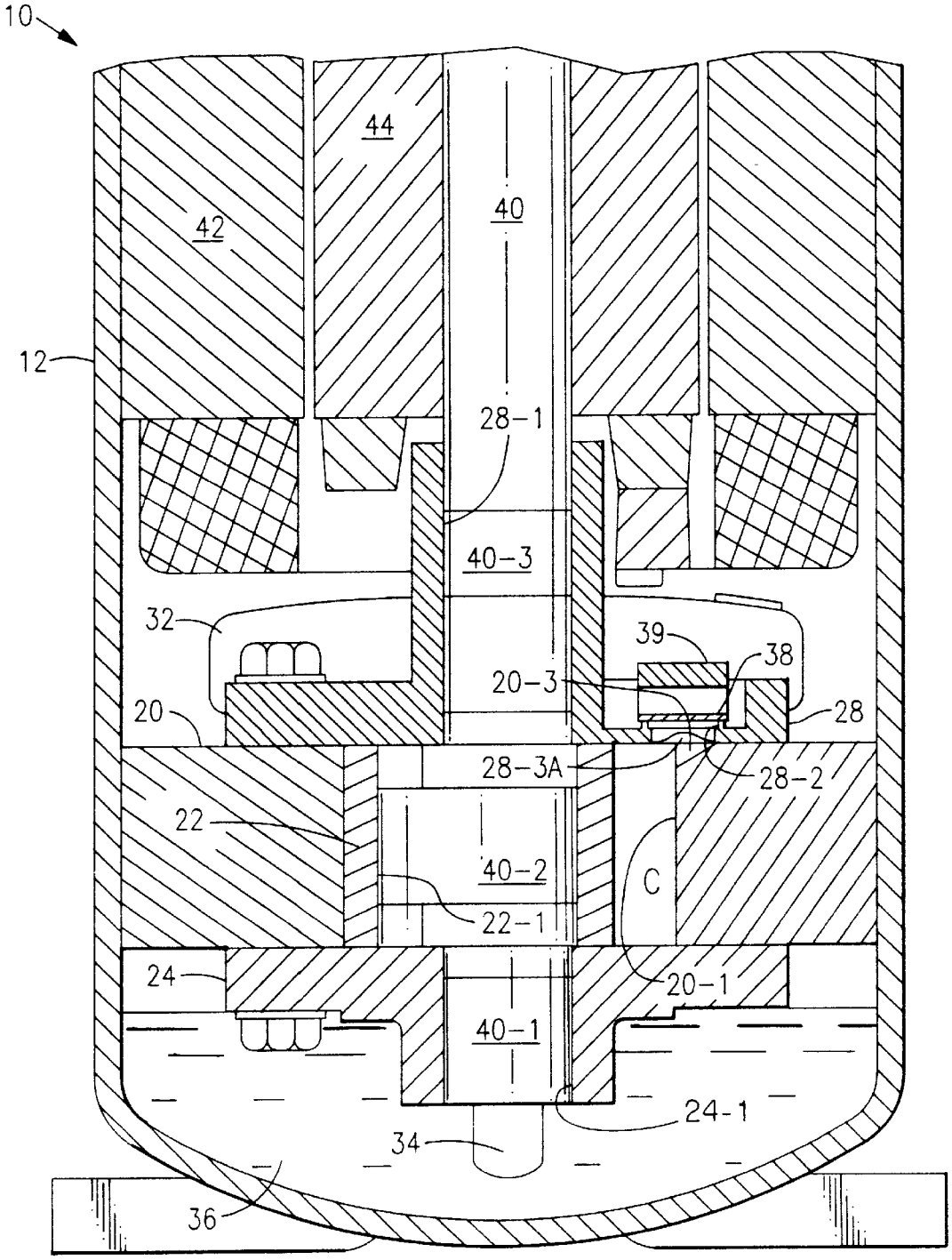
FIG. 3 is a partial, vertical sectional view corresponding to that of FIG. 1 but taken through the discharge structure which is the subject matter of this invention.

In FIGS. 1–3, the numeral 10 generally designates a vertical, high side rolling piston compressor. The numeral 12 generally designates the shell or casing. Suction tube 16 is sealed to shell 12 and provides fluid communication between suction accumulator 14, which is connected to the evaporator (not illustrated), and suction chamber S. Suction chamber S is defined by bore 20-1 in cylinder 20, piston 22, pump end bearing 24 and motor end bearing 28.

Eccentric shaft 40 includes a portion 40-1 supportingly received in bore 24-1 of pump end bearing 24, eccentric 40-2 which is received in bore 22-1 of piston 22, and portion 40-3 supportingly received in bore 28-1 of motor end bearing 28. Oil pick up tube 34 extends into sump 36 from a bore in portion 40-1. Stator 42 is secured to shell 12 by shrink fit, welding or any other suitable means. Rotor 44 is suitably secured to shaft 40, as by a shrink fit, and is located within bore 42-1 of stator 42 and coacts therewith to define an electric motor. Vane 30 is biased into contact with piston 22 by spring 31.

Figure 5:
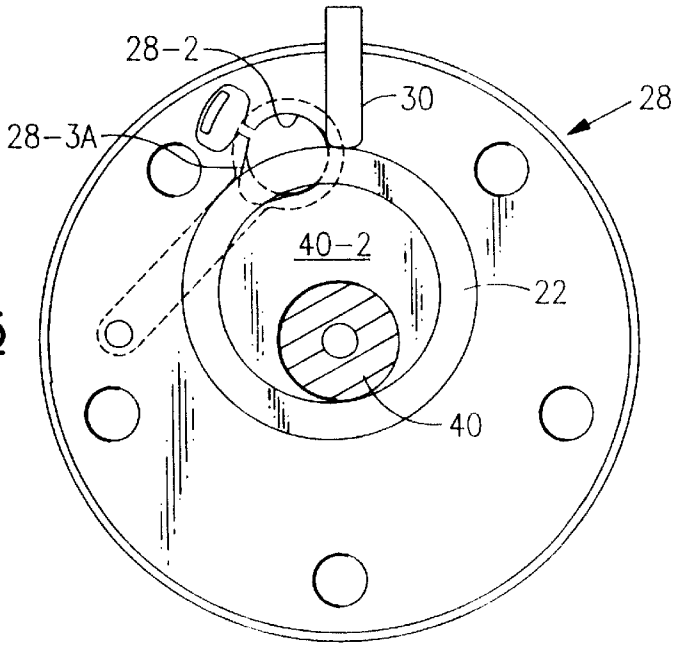
FIG. 5 is a view corresponding to that of FIG. 4 but with the shaft, piston and vane added.
Figure 4A:
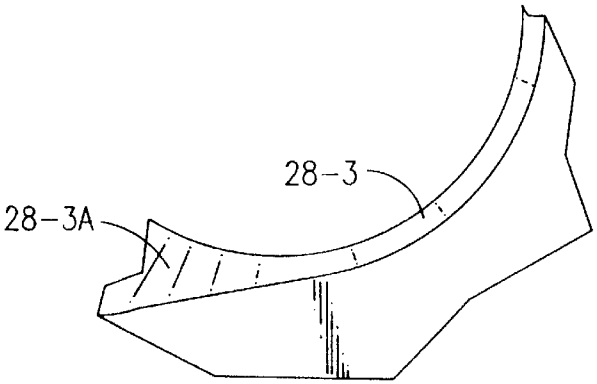
FIG. 4A is an enlarged view of a portion of FIG. 4.
Figure 4:
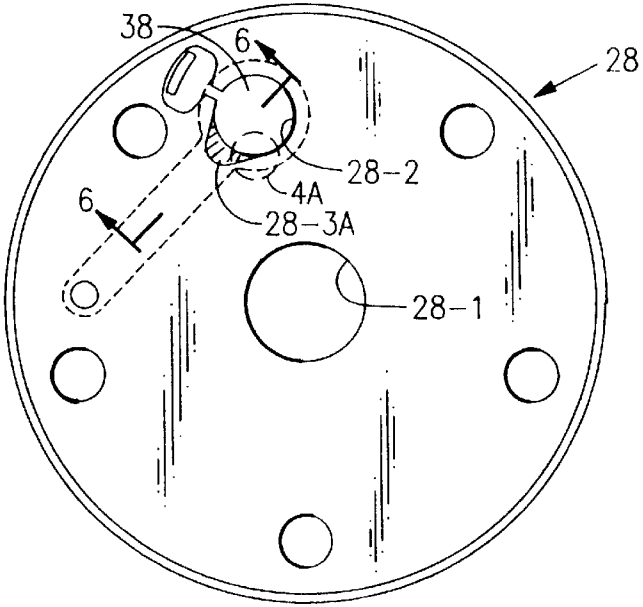
FIG. 4 is a pump end view of the motor bearing.
Figure 6:
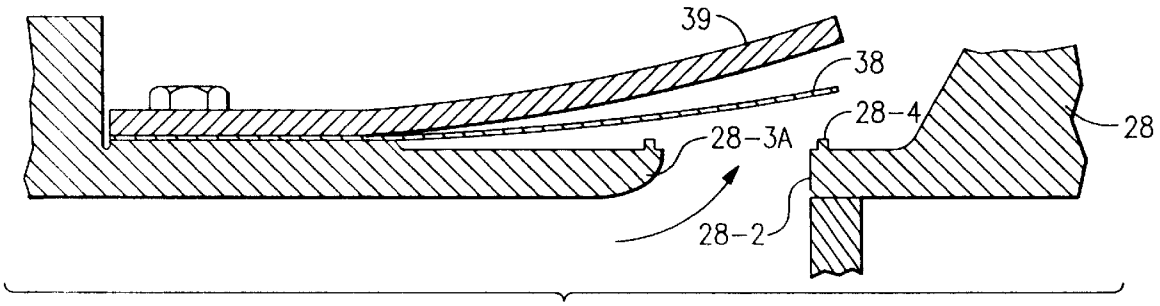
FIG. 6 is a sectional view taken along line 6—6 of FIG. 4.

Referring to FIG. 3, discharge port 28-2 is formed in motor end bearing 28 and partially overlies bore 20-1 and overlies discharge recess 20-3 which is best shown in FIG. 2 and which provides a flow path from compression chamber C to discharge port 28-2. Discharge port 28-2 is serially overlain by discharge valve 38 and spaced valve stop 39, as is conventional. As described so far, compressor 10 is generally conventional. The present invention adds notch 28-3A which is best shown in FIGS. 3–6. In FIG. 3 the view of notch 28-3A is that seen when looking in the direction of the axis of valve 28 towards the fixed end of valve 28. Notch 28-3A is a more extensively recessed portion of chamfer 28-3, as best shown in FIG. 4A, and has a projected profile that has a curved shape that intersects with the discharge port 28-2 or, preferably, with the discharge port chamfer 28-3. Notch 28-3A is symmetrical with the axis of the discharge valve 38. Notch 28-3 can be 10° to 180° in circumferential extent, but is preferably 90° or less, and corresponds, in part, to a portion of discharge port 28-2 overlying bore 20-1, or, more specifically, compression chamber C. As best shown in FIG. 5, where the piston 22 and vane 30 are 180° in the cycle from the FIG. 2 position and where the discharge cycle has ended and the suction cycle is ending, the notch 28-3A mostly overlies cylinder 20 but because of its limited circumferential extent it does not significantly add to the clearance volume. Notch 28-3A is located, however, where at least some of the flow from compression chamber C to discharge port 28-2 would otherwise be over a 90° edge with attendant losses. As best shown in FIG. 6, the valve 38 is flexed on opening and has its greatest distance from valve seat 28-4 and hence the least resistance to flow on the side of discharge port 28-2 opposite to notch 28-3A. Accordingly, flow passing through notch 28-3A tends to be diverted to a limited degree such that the flow tends to go diagonally across port 28-2 with only a glancing impingement on valve 38 and passing past the tip of valve 38. This should be contrasted with a flow straight through port 28-2 such that it directly impinges upon valve 38 and is directed, in part, to the sides of valve 38 and requiring a subsequent 90° change in flow direction.

In operation, rotor 44 and eccentric shaft 40 rotate as a unit and eccentric 40-2 causes movement of piston 22. Oil from sump 36 is drawn through oil pick up tube 34 into bore 40-4 which acts as a centrifugal pump. The pumping action will be dependent upon the rotational speed of shaft 40. Oil delivered to bore 40-4 is able to flow into a series of radially extending passages, in portion 40-1, eccentric 40-2 and portion 40-3 to lubricate bearing 24, piston 22, and bearing 28, respectively. Piston 22 coacts with vane 30 in a conventional manner such that gas is drawn through suction tube 16 and passageway 20-2 to suction chamber S. The gas in suction chamber S is trapped, compressed and discharged from compression chamber C via a flow path defined by notch 28-3A and recess 20-3 into discharge port 28-2. The high pressure gas unseats the valve 38 and passes into the interior of muffler 32. The compressed gas passes through muffler 32 into the interior of shell 12 and passes via the annular gap between rotating rotor 44 and stator 42 and through discharge line 60 to the condenser 70 of a refrigeration circuit (not illustrated).

At the completion of the compression process, the direction of motion of piston 22 will be tangent to the bore 20-1, in the region of recess 20-3 or, nominally, as shown in FIG. 5. The clearance volume will be the volume of recess 20-3, the volume of discharge port 28-2, the volume of chamfer 28-3, and the volume of the material removed to form notch 28-3A. Accordingly, the increase in the clearance volume is minimized due to the reduced circumferential extent of notch 28-3A.

Figure 7:
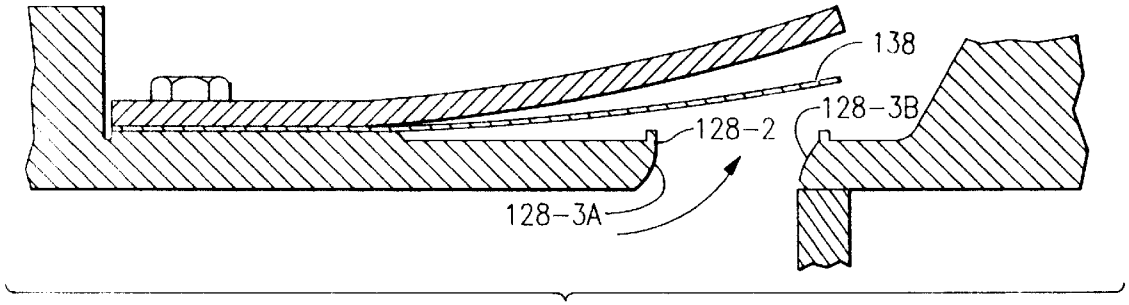
FIG. 7 is a view corresponding to FIG. 6 showing a first modified embodiment.

Referring now to FIG. 7, a modified discharge port 128-2 is disclosed. Port 128-2 differs from port 28-2 by the addition of a second flow guiding surface 128-3B located across port 128-2 from notch 128-3A. Notch 128-3A and guiding surface 128-3B coact to provide a streamlined flow and to guide the flow in a direction along the axis of valve 138 such that the flow tends to glance off valve 138 and flow past the tip of valve 138.

Figure 8:
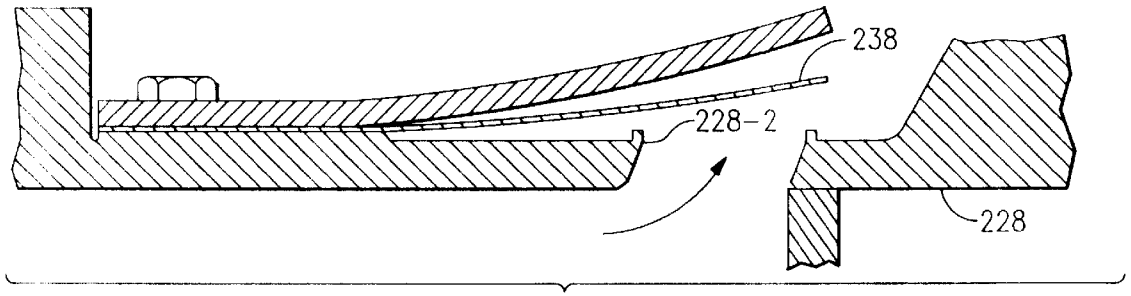
FIG. 8 is a view corresponding to FIG. 6 showing a second modified embodiment.

Referring now to FIG. 8, a second modified discharge port 228-2 is disclosed. Discharge port 228-2 is circular but formed at an angle in motor end bearing 228 such that flow through port 228-2 is directed towards the free end of valve 238. The angle of port 228-2 effectively forms an inlet notch and a discharge notch when port 228-2 is viewed straight on.

Although the present invention has been illustrated and described in terms of a vertical, variable speed compressor, other modifications will occur to those skilled in the art. For example, the invention is applicable to both horizontal and vertical compressors using discharge valves. Similarly the motor may be a variable speed motor. It is therefore intended that the present invention is to be limited only by the scope of the appended claims.

What is claimed is:

1. A high side rotary compressor comprising:

a shell having a first end and a second end;

a cylinder having a bore containing pump structure including a vane and a piston coacting with said cylinder to define suction and compression chambers;

said cylinder being fixedly located in said shell near said first end;

a first bearing underlying said bore and secured to said cylinder and extending towards said first end;

a second bearing secured to said cylinder, overlying said bore and extending towards said second end;

a motor including a rotor and a stator;

said stator being fixedly located in said shell between said cylinder and said second end and axially spaced from said cylinder and said second bearing;

an eccentric shaft supported by said first and second bearings and including an eccentric operatively connected to said piston;

said rotor secured to said shaft so as to be integral therewith and located within said stator so as to define therewith an annular gap;

means for supplying gas to said pump structure;

a discharge fluidly connected to said shell;

a discharge port located in said second bearing;

a recess located in said cylinder and communicating with said discharge port;

a valve overlying said discharge port;

said valve having an axis extending between two ends with a first end being secured to said second bearing so as to permit flexure of said valve and a second end coacting with said discharge port to control flow therethrough;

a notch formed in said discharge port on the cylinder side of said second bearing and on the side of said discharge port towards said first end of said valve;

a muffler overlying said valve;

a discharge flow path extending between said compression chamber and said discharge and including said recess, said notch in said second bearing, said discharge port, said valve and, said muffler and the interior of said shell; and said recess and said notch coacting to direct flow into said discharge port in a streamlined fashion with flow from said discharge port discharging into said muffler and thence passing into the interior of said shell.

2. The compressor of claim 1 wherein said notch is no more than 180° in circumferential extent.

3. The compressor of claim 1 wherein said notch is of a curved shape.

4. The compressor of claim 1 wherein the portion of the discharge port facing said notch is relieved and coacts with said notch to direct flow through said discharge port towards said second end of said valve.

5. In a compressor having a discharge chamber, a discharge port in fluid communication with said discharge chamber, an enhanced discharge port comprising:

said discharge port being in a member having a first side and a second side with said discharge port extending between said first and second sides;

a valve having a first end and a second end with said first end and said second end defining an axis;

said valve being pivotably secured at said first end to said first side of said member such that said second end overlies and coacts with said discharge port in a valving action;

an entrance to said discharge port being located in said second side of said member and including a notch extending in the direction of said axis towards said first end of said valve whereby flow entering said discharge port tends to be directed towards said second end of said valve.

6. The discharge port of claim 5 wherein said notch is no more than 180° in circumferential extent.

7. The discharge port of claim 5 wherein said notch is of a curved shape.

8. The discharge port of claim 5 wherein the portion of the discharge port facing said notch is relieved and coacts with said notch to direct flow through said discharge port towards said second end of said valve.

* * * * *